US011273349B2

(12) United States Patent
Goldberg

(10) Patent No.: US 11,273,349 B2
(45) Date of Patent: Mar. 15, 2022

(54) SPORTS TARGET DEVICE FEATURING ELASTIC RETURN MECHANISM

(71) Applicant: Robert Marc Goldberg, Fayetteville, NY (US)

(72) Inventor: Robert Marc Goldberg, Fayetteville, NY (US)

( * ) Notice: Subject to any disclaimer, the term of this patent is extended or adjusted under 35 U.S.C. 154(b) by 0 days.

(21) Appl. No.: 16/704,633

(22) Filed: Dec. 5, 2019

(65) Prior Publication Data

US 2020/0254318 A1 Aug. 13, 2020

Related U.S. Application Data

(60) Provisional application No. 62/775,583, filed on Dec. 5, 2018.

(51) Int. Cl.

| | |
|---|---|
| ***A63B 63/06*** | (2006.01) |
| ***A63B 63/00*** | (2006.01) |
| *A63B 102/22* | (2015.01) |
| *A63B 102/14* | (2015.01) |

(52) U.S. Cl.
CPC ..... *A63B 63/004* (2013.01); *A63B 63/06* (2013.01); *A63B 2102/14* (2015.10); *A63B 2102/22* (2015.10)

(58) Field of Classification Search
CPC ..... A63B 63/004; A63B 63/06; F41J 7/04
See application file for complete search history.

(56) References Cited

U.S. PATENT DOCUMENTS

| | | | | |
|---|---|---|---|---|
| 4,245,843 | A * | 1/1981 | Griggs | A63B 63/00 273/380 |
| 4,842,283 | A * | 6/1989 | LeBel | A63B 63/004 273/392 |
| 5,628,515 | A * | 5/1997 | Levy | A63B 63/06 273/392 |
| 7,252,604 | B2 * | 8/2007 | Birss | A63B 63/003 273/392 |
| 9,457,249 | B2 * | 10/2016 | Goldberg | H04M 1/725 |
| 9,573,036 | B2 * | 2/2017 | Markham | A63B 69/002 |
| 9,694,266 | B2 * | 7/2017 | Marcin | A63B 63/004 |
| 2008/0312011 | A1 * | 12/2008 | Edmondson | A63B 69/0002 473/456 |
| 2009/0036238 | A1 * | 2/2009 | Sheehan | A63B 63/003 473/446 |
| 2015/0273296 | A1 * | 10/2015 | Marcin | A63B 63/003 473/446 |
| 2018/0056141 | A1 * | 3/2018 | Fant | A63B 69/345 |

OTHER PUBLICATIONS

ECD Lacrosse, "How to Install the ECD Shooting Targets" YouTube video, www.youtube.com/watch?v=JcbCXI0azKI, uploaded Nov. 27, 2017 (Year: 2017).*

* cited by examiner

*Primary Examiner* — Laura Davison
(74) *Attorney, Agent, or Firm* — Paul Frank + Collins P.C.

(57) ABSTRACT

A target assembly that is configured to withstand high-velocity impact from a projectile. These configurations may comprise elastic members, or "bungee" cords, that generate elastic forces to return the target assembly to its orientation prior to impact. The bungee cords are less likely to undergo inelastic deformation; so these components afford the target assembly with longer life or longevity under heavy duty cycles.

20 Claims, 6 Drawing Sheets

SPORTS TARGET DEVICE FEATURING ELASTIC RETURN MECHANISM

CROSS-REFERENCE TO RELATED APPLICATIONS

This application claims the benefit of priority to U.S. Ser. No. 62/775,583, filed on Dec. 5, 2018, and entitled "TARGET ASSEMBLY." The content of this application is incorporated herein by reference in its entirety.

BACKGROUND

Practice aids enjoy wide use in sports training. Many devices exist with individual "targets" that attach to a "goal" so that the target covers a small part or portion of the goal opening (or "goal mouth"). Athletes leverage the targets for throwing or shooting drills that hone skills important for game play. The targets may focus the athletes' attention to specific areas, like corners and sides of the goal mouth, because these areas may advantageously allow the athlete to score. For best results, practice regimens call for athletes to repeatedly attempt to hit the targets. This repetitive motion develops accuracy that may translate into better scoring chances in a game or contest. In sports like hockey or lacrosse, though, the targets are much more susceptible to damage because the projectile (the puck or ball) is made of very hard rubber and travels at very high speeds (often in excess of 90 mph).

SUMMARY

The subject matter of this disclosure relates to construction of targets to improve longevity under these conditions. Of particular interest are embodiments that employ resilient or elastic materials, like "bungee," with properties that are less susceptible to inelastic deformation. These embodiments may attach to a frame that mounts to the goal. Examples of frames are found in commonly-owned U.S. Pat. No. 9,457,249 or U.S. Ser. No. 16/165,308; however, the concepts here may apply to other devices as well. In use, the target may move (e.g., swing or turn) between orientations relative to the frame in response to impact from the projectile. The bungee forms part of a return mechanism that causes the target to return to its first or initial orientation after impact. This mechanism provides repeatable, long term return of the target to its initial orientation under high duty cycles.

DRAWINGS

Reference is now made briefly to the accompanying drawings, in which.

Figure 1:
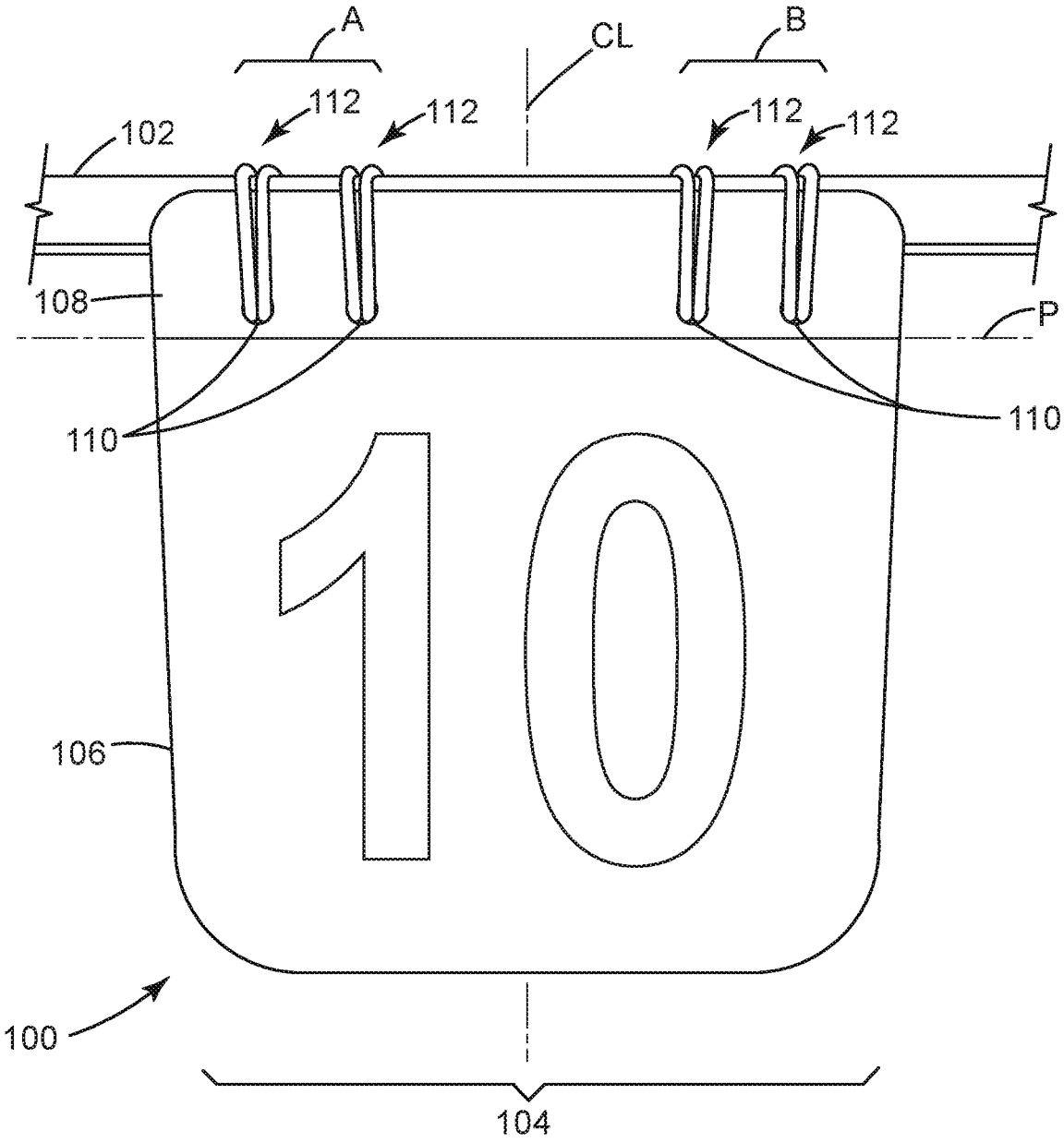
FIG. 1 depicts an elevation view of the front of an exemplary embodiment of a target.

Where applicable, like reference characters designate identical or corresponding components and units throughout the several views, which are not to scale unless otherwise indicated. The embodiments disclosed herein may include elements that appear in one or more of the several views or in combinations of the several views. Moreover, methods are exemplary only and may be modified by, for example, reordering, adding, removing, and/or altering the individual stages.

DETAILED DESCRIPTION

Excellence in athletics is due in large part to practice. Athletes spend countless hours at home or at practice facilities to hone their skills. Often, they perform repetitive drills to develop proper mechanics or muscle memory that translates into success in game play. Many products are available to assist in this endeavor. These products may include targets to improve shot or pass accuracy. In use, athletes throw or direct a projectile, like a ball or puck, over-and-over again at the targets.

Targets and target assemblies according to this disclosure may find use in these products. These targets employ a design that permits movement between an initial orientation and an impacted orientation. The design incorporates a return mechanism that repeatedly returns the target to its initial position, though, even after multiple high-velocity impacts. This mechanism may leverage elastic or spring-like devices for this purpose. These devices may react (e.g., deform) to movement of the target from its initial orientation. The deformation may generate elastic or spring forces that act in opposition to the direction of movement and return the target to its initial orientation Other embodiments are within the scope of the subject matter herein.

FIG. 1 depicts a perspective view from the front an example of a target 100. This example is shown in position on a rigid member 102, typically a stiff, metal rod or tube made from steel or aluminum. This tube may incorporate into a frame that can attach to a sports goal. The target 100 may have an impact body 104 that bears impact from the projectile. The impact body 104 may have several parts (e.g., a first part 106 and a second part 108). The parts 106, 108 may affix to one another with adhesive or fasteners, like screws or bolts. The first part 106 may embody a flat or thin panel that is square or circular, although other shapes may suffice as well. Material(s) for the flat panel 106 should have properties to withstand high-velocity impacts. Stiff foam or rubber may work for this purpose, but other materials (alone or in combination or composite) may work so long as they don't shatter or break at impact. The second part 108 may embody a rigid strip that attaches on a forward or impact face of the foam panel 106, which is effective to reinforce the foam panel 106. Plastics, like ABS (or Acrylonitrile Butadiene Styrene), may be useful for this purpose. The plastic strip 108 may cover only a portion of the surface area of the impact face of the foam panel 106. In one implementation, it may extend along all or part of an edge on the foam panel 106. This edge may reside proximate the frame member 102 with the target 100 resident on the frame. As shown, the plastic strip 108 may extend over the edge so part of it overlaps with the frame member 102.

As also shown, lateral openings 110 may penetrate through one or both parts 106, 108. The openings 110 may embody through-holes with centers that closely align with one another on a lateral plane P. The holes 110 may be spaced laterally apart from one another across the impact face of the parts 106, 108 as well. This example has two sets of holes (A, B), one each on either side of the centerline CL of the parts 106, 108. But the device may benefit from more or less of the holes 110 as desired. In one implementation, the holes 110 may receive tension members 112 to create a tension pre-load that biases the impact body 104 in a first or initial orientation (shown here in FIG. 1).

Figure 2:
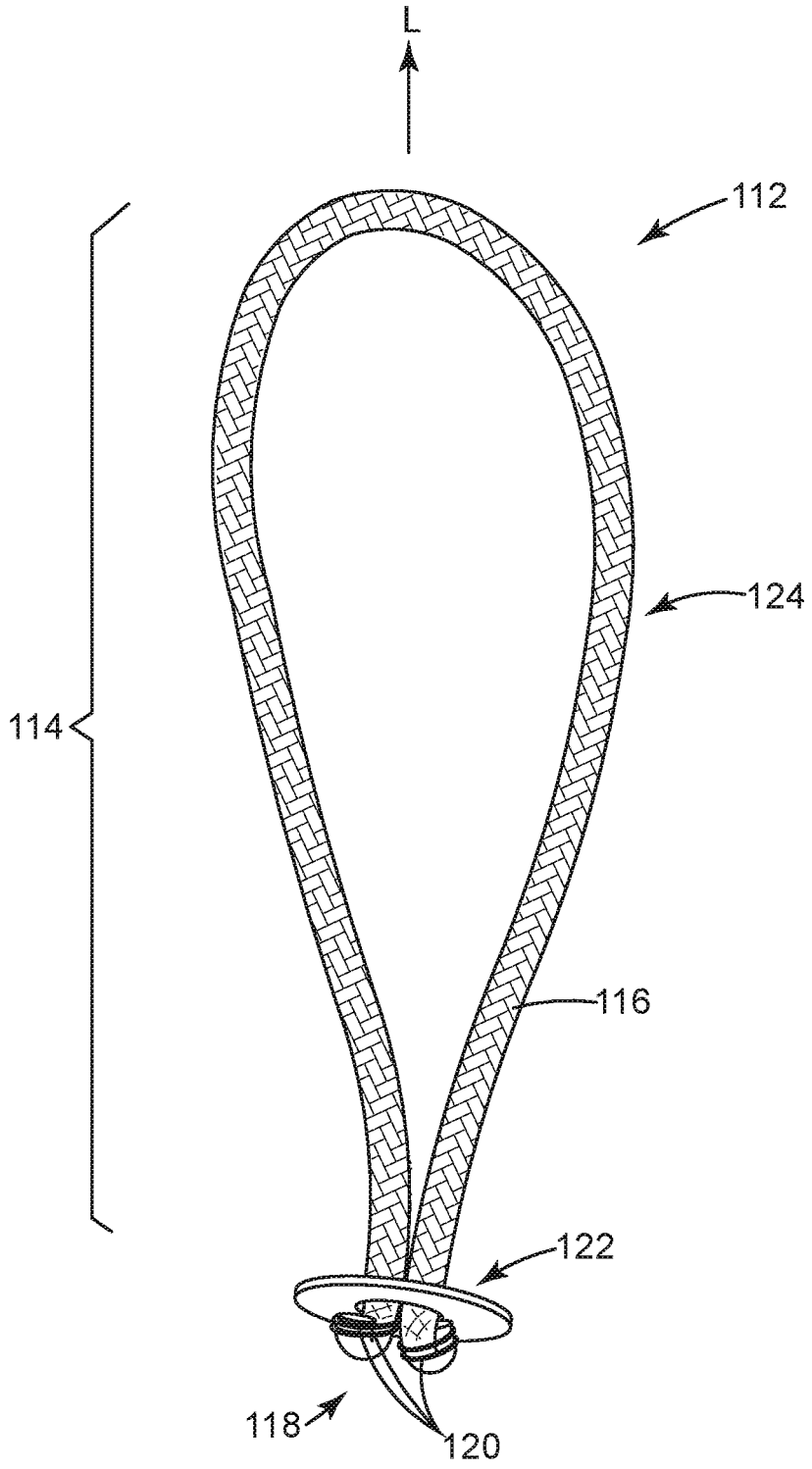
FIG. 2 depicts an elevation view of a tension member for use on the target of FIG. 1.

FIG. 2 depicts an elevation view of an example of the tension members 112. This example includes an elastic cord 114. Preference may be given to materials for the elastic cords 112 that can elongate in response to movement of the impact body 104 and then return to their original length. These materials may include "bungee" or shock cord, or like elastic materials (e.g., rubber). The bungee cord 114 may include an elongate body 116 that terminates at a pair of ends 118, each with a crimped ring 120 disposed thereon. When assembled into the tension member 112, the elongate body 116 may fold (in half) to insert into a retaining member 122, for example, a flat washer or ring made of metal or hard plastic. This arrangement forms a closed loop 124 because the flat washer 122 may have an inner diameter that retains the crimped rings 118 on one side. Dimensions for the inner diameter can maintain this location of the crimped rings 118 when pulling or loading the closed loop 124 (as indicated by the arrow L).

Figure 3:
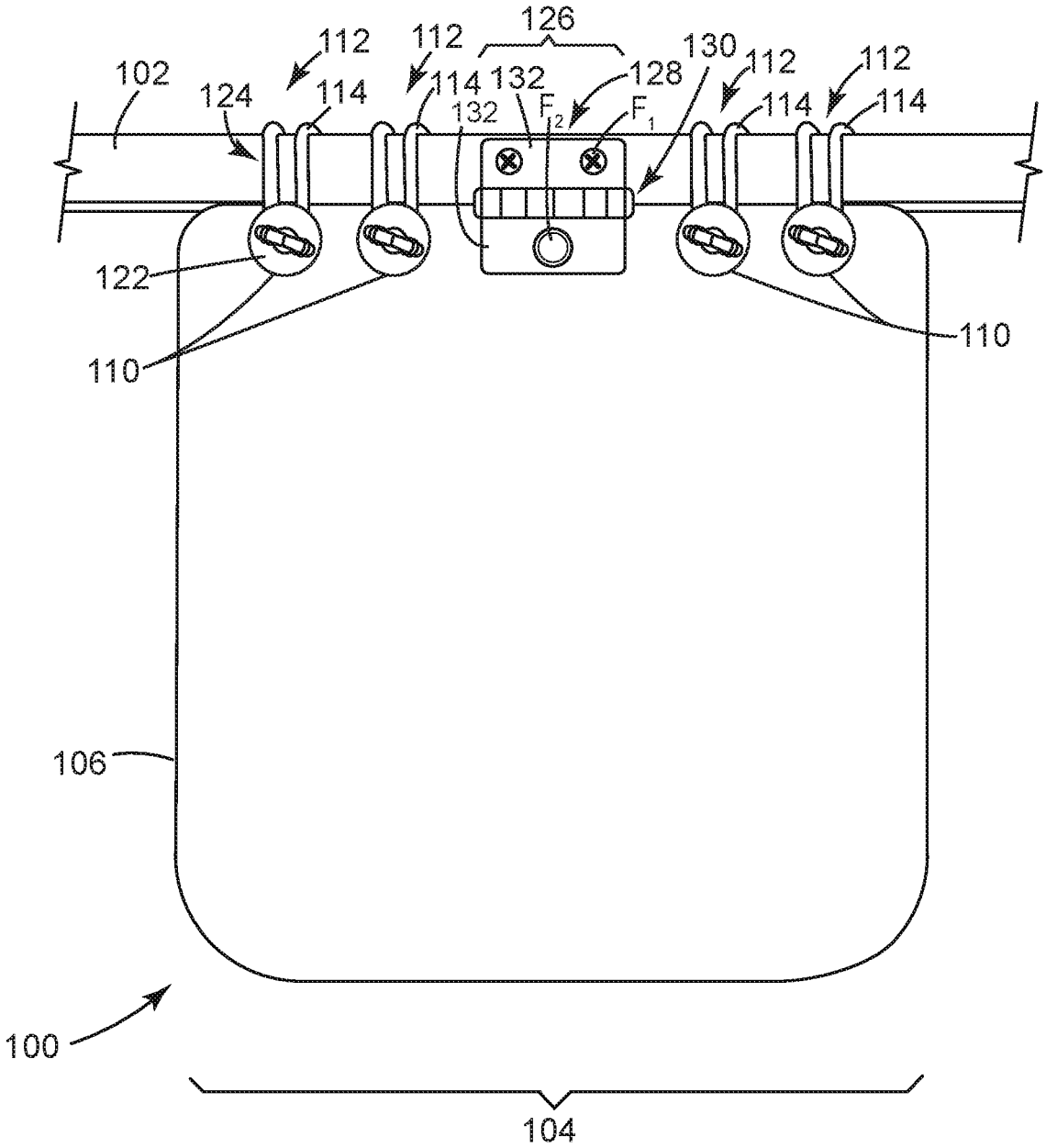
FIG. 3 depicts an elevation view of the back of the target of FIG. 1.

FIG. 3 depicts an elevation view of the backside of the target 100 of FIG. 1. The closed loop 124 may insert through the holes 110 from the backside of the foam panel 106. The flat washer 122 acts as a stop so that the closed loop 124 can stretch to extend or wrap over the frame member 102 from the front side to the backside of the foam panel 106. In one implementation, the closed loop 124 can loop around the flat washer 122. This arrangement creates the tension pre-load in each of the tension members 112. The pre-load may correspond with the length of the bungee cords 114 and the location of the holes 110 relative to the frame member 102, among other factors.

As noted above, the impact body 104 may be configured to change orientation relative to the frame member 102 in response to impact from the projectile. These configurations may use a joint 126 to couple the impact body 104 to the frame member 102. The joint 126 may embody devices that provide sufficient degrees-of-freedom to allow for movement of the impact body 104 relative to the frame member 102. The device here has one degree-of-freedom for the impact body 104 to effectively "swing" relative to the frame member 102. In one implementation, the device may use a hinge 128 with several components, like a pin joint 130 that connects corresponding leaves 132, one each that mounts to the frame member 102 and the backside of the foam panel 106 (with fasteners $F_1$ and $F_2$). The pin joint 130 stabilizes the impact body 104 so that it does not twist or turn in response to "off-center" contact by the projectile.

Figure 4:
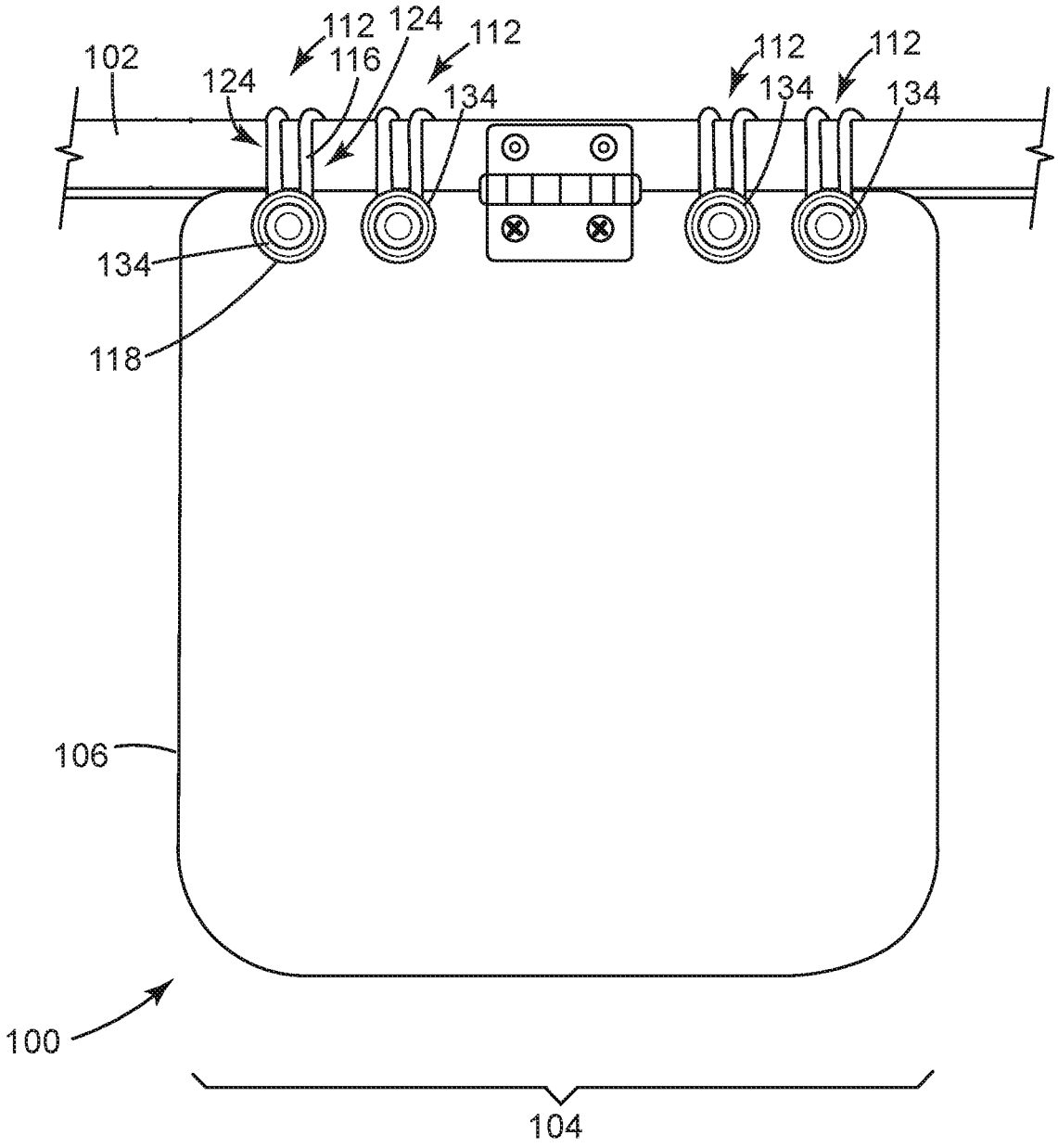
FIG. 4 depicts an elevation view of the back of another example of the target 100 of FIG. 1.

FIG. 4 depicts an elevation view of another example of the retaining member 122. This example may embody a ball 134 (typically metal or plastic) with a central opening 136, for example, a counter-bored through-hole. Ends 118 of the elongate body 116 may be knotted and reside in the counterbore. This arrangement also forms a closed loop 124 as the knotted ends 118 prevent the elongate body 116 from pulling out of the ball 134 under load L (FIG. 2). When assembled, the closed loop 124 engages with the ball 134 on the backside of the foam panel 106.

Figure 5:
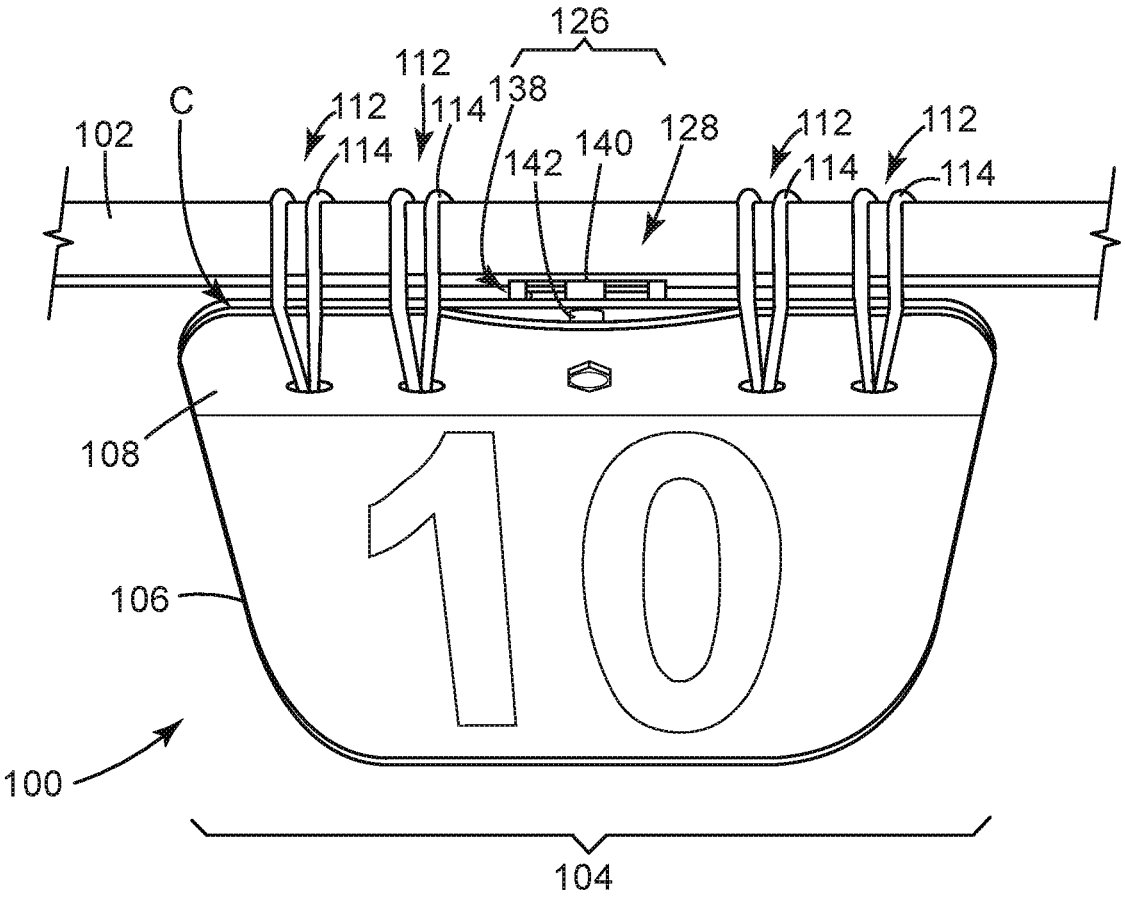
FIG. 5 depicts a plan view of the top of the target of FIG. 1.

FIG. 5 depicts a plan view of the top of the target 100 of FIG. 1. The target 100 is shown in a second or impacted orientation that might result from impact by the projectile. In use, movement of the impact body 104 to the impacted orientation may stretch the bungee cords 114, generating an internal elastic force (or elasticity) that returns the impact body 104 to its initial orientation. The plastic strip 108 may serve several roles as well. First, it may press against the closed loop 124 (at C) to increase the elastic force. It may also prevent "over-rotation" of the impact body 104, contacting the frame member 102 to ensure that the impact body 104 resides in its initial orientation (FIG. 1), which is essentially planar with the outwardly facing surface of the frame member 102. Further, the plastic strip 108 may protect the hinge 128 from impact by the projectile to avoid damage from high-velocity shots.

The target 100 may benefit from a sensing mechanism 138 that can register the change in orientation. The sensing mechanism 138 may embody devices that do not require contact between sensor and emitter. These non-contact devices may deploy various modalities, including optical, ultrasonic, or magnetics; however, other types of sensors may be useful as well. In one implementation, the device may include a magnetic sensor 140 (on the frame member 102) that detects proximity of a magnetic field from a magnet 142 (on the foam panel 106). Movement of the impact body 104 from the initial orientation (FIG. 1) to the impacted orientation may separate the magnet 142 from the sensor 140 enough to break continuity in the magnetic sensor 140 (or cause some other response as desired or designed).

Figure 6:
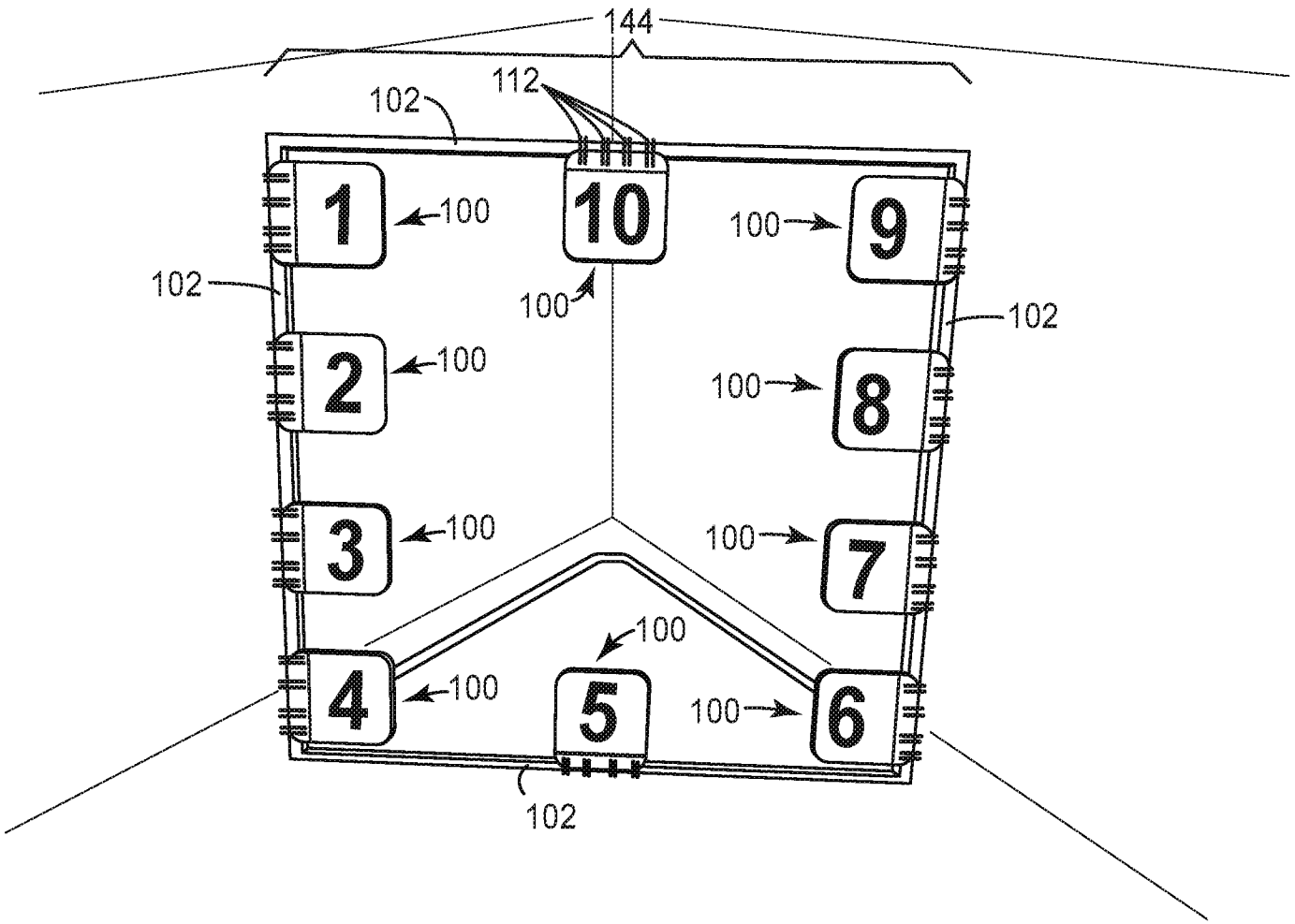
FIG. 6 depicts an elevation view of the target of FIG. 1 as part of a practice aid.

FIG. 6 depicts a perspective view of one application of the target 100 of FIG. 1. This application includes a large frame 144 with a number of frame members 102. The frame 144 may fit onto a lacrosse goal or hockey goal, but dimensions may vary as desired. As discussed herein, the frame 144 accommodates several of the targets 100, disposed on the frame members 102. The tension members 112 maintain each of the targets 100 in their initial orientation. Impact by the projectile on the individual targets 100 will cause it to move to its impacted orientation. The tension members 112 will return the impacted target 100 back to its initial orientation almost immediately thereafter.

In view of the foregoing, the embodiments herein are meant to withstand long-term high-velocity impacts from projectiles, like hockey pucks, lacrosse balls, and baseballs. The resilient, elastic return mechanism is useful because it does not undergo inelastic deformation, which may over-time adversely affect springs (e.g., wound coil springs). This improvement results in a target (or target assembly) with better longevity. This feature can reduce costs and labor for manufacturers because these targets are less likely to require repair or replacement parts, if at all.

This written description uses examples to disclose the invention, including the best mode, and also to enable any person skilled in the art to practice the invention, including making and using any devices or systems and performing any incorporated methods. An element or function recited in the singular and proceeded with the word "a" or "an" should be understood as not excluding plural said elements or functions, unless such exclusion is explicitly recited. References to "one embodiment" of the claimed invention should not be interpreted as excluding the existence of additional embodiments that also incorporate the recited features. Furthermore, the claims are but some examples that define the patentable scope of the invention. This scope may include and contemplate other examples that occur to those skilled in the art. Such other examples are intended to be within the scope of the claims if they have structural elements that do not differ from the literal language of the claims, or if they include equivalent structural elements with insubstantial differences from the literal language of the claims.

Examples appear below that include certain elements or clauses one or more of which may be combined with other elements and clauses describe embodiments contemplated within the scope and spirit of this disclosure.

What is claimed is:

1. A target assembly, comprising:

an impact body having an impact side and a backside;

a hinge coupled with the impact body;

a rigid strip that overlaps with the hinge;

a sensing mechanism disposed on the impact body and proximate the hinge to register actuation of the hinge; and a return mechanism comprising elastic tension members that couple with the impact body to maintain the impact body in at least one orientation, wherein the elastic tension members each have an elongated body that extends over an edge of the impact body from the impact side to the backside to create a tension pre-load, and wherein the rigid strip attaches to the impact side of the impact body and extends over the edge of the impact body so as to come in contact with and increase tension in the elastic tension members in response to actuation of the hinge.

2. The target assembly of claim 1, wherein the elastic tension members extend through the impact body.

3. The target assembly of claim 1, wherein the impact body comprises a foam panel and the rigid strip comprises a plastic strip that attaches along the edge of the foam panel.

4. The target assembly of claim 1, wherein the impact body comprises a foam panel and the rigid strip comprises a plastic strip that extends lengthwise along the edge of the foam panel.

5. The target assembly of claim 1, wherein the elastic tension members comprise bungee cords.

6. The target assembly of claim 1, wherein the elastic tension members comprise bungee cords and a retaining mechanism that retains ends of the bungee cords on one side of the impact body.

7. The target assembly of claim 1, wherein the impact body comprises openings spaced laterally apart from one another to receive the elastic tension members.

8. The target assembly of claim 1, wherein the hinge has one degree-of-freedom.

9. The target assembly of claim 1, wherein the hinge comprises a pin and two leaves, one of which secures to the impact body.

10. The target assembly of claim 1, wherein the impact body comprises a foam panel and the rigid strip comprises a plastic strip that overlaps both the impact side of the foam panel and an adjacent member of a metal frame when the hinge mounts to the metal frame.

11. A target, comprising:

a foam panel having an impact side and a backside;

a hinge disposed on the foam panel;

a sensing mechanism disposed on the foam panel in a position to register movement of the foam panel relative to a fixed surface;

a plastic strip attached to the foam panel and overlapping the hinge;

openings in the foam panel and the plastic strip; and elastic members disposed in the openings, wherein the elastic members each have an elongated body that extends over an edge of the foam panel from the impact side to the backside to create a tension pre-load, and wherein the plastic strip attaches to the impact side of the foam panel and extends over the edge of the foam panel so as to come in contact with and increase tension in the elastic members in response to movement of the foam panel.

12. The target of claim 11, wherein the openings are disposed laterally along a face of the foam panel and the plastic strip.

13. The target of claim 11, wherein the openings in the foam panel and the plastic strip align with one another.

14. The target of claim 11, wherein the elastic members comprise a bungee cord and a retaining member, the combination of which forms the bungee cord into a closed loop.

15. The target of claim 11, further comprising:

a retaining mechanism to secure ends of the elastic members on one side of foam panel.

16. The target of claim 11, further comprising:

for each of the elastic members, a flat washer disposed on one side of the foam panel; and a crimped ring disposed on ends of the elastic member, wherein the elastic member extends through the flat washer to form a closed loop on a first side of the washer and the crimped ring on a second side of the washer.

17. The target of claim 11, wherein the elongated body secures on the backside to create the tension pre-load.

18. The target of claim 11, wherein the plastic strip extends laterally and continuously along the edge of the foam panel.

19. The target of claim 11, wherein the hinge comprises a pin and at least one leaf that couples with the foam panel.

20. The target of claim 11, wherein the plastic strip overlaps both the impact side of the foam panel and an adjacent member of a metal frame when the hinge mounts to the metal frame.

* * * * *